United States Patent [19]

Allen et al.

[11] Patent Number: 5,043,900

[45] Date of Patent: Aug. 27, 1991

[54] IGNITION SYSTEM WITH FEEDBACK CONTROLLED DWELL

[75] Inventors: William R. Allen, Redford; Edward L. Korte, Dearborn Heights; James T. Lee, Monroe; Ira C. Miller, Jr., Warren; Kent A. Wikarski, St. Clair Shores, all of Mich.

[73] Assignee: Ford Motor Company, Dearborn, Mich.

[21] Appl. No.: 506,745

[22] Filed: Apr. 10, 1990

Related U.S. Application Data

[63] Continuation of Ser. No. 252,625, Oct. 3, 1988, Pat. No. 4,933,861.

[51] Int. Cl.[5] ..... F02P 3/045; F02P 3/05

[52] U.S. Cl. ..... 364/431.04; 364/431.03; 123/609; 123/644

[58] Field of Search ..... 364/431.04, 431.05, 364/431.03; 123/644, 609, 417

[56] References Cited

U.S. PATENT DOCUMENTS

| | | | |
|---|---|---|---|
| 4,446,843 | 5/1984 | Rumbaugh et al. | 123/609 |
| 4,711,226 | 12/1987 | Newhalfen et al. | 123/609 |
| 4,773,380 | 9/1988 | Narita et al. | 123/609 |

*Primary Examiner*—Parshotam S. Lall
*Assistant Examiner*—V. N. Trans
*Attorney, Agent, or Firm*—Peter Abolins; Keith L. Zerschling

[57] ABSTRACT

Controlling ignition current in the ignition control system of an internal combustion engine includes determining the amount of time it takes current in the ignition coil to reach a desired or limit value and adjusting the time of starting ignition coil charging before spark firing to be substantially equal to the amount of time it takes ignition coil charging current to reach the desired or limit current value.

8 Claims, 6 Drawing Sheets

IGNITION SYSTEM WITH FEEDBACK CONTROLLED DWELL

This is a continuation of application Ser. No. 07/252,625, filed Oct. 3, 1988, now U.S. Pat. No. 4,933,861.

BACKGROUND OF THE INVENTION

1. Field of the Invention

This invention relates to controlling the ignition system of an internal combustion engine.

2. Description of the Prior Art

An historic problem with ignition modules has been the large build up of heat at the ignition module output transistor, especially when the engine is at idle and the amount of air flow cooling the ignition module is at a minimum. This heat build up is the result of holding the ignition coil current at a desired current limit for some period of time while waiting for the engine control computer to command the discharging of the coil through the spark plug.

The problem of avoiding excess ignition coil current is further compounded by the lack of accurate engine Position information due to infrequent position information input, i.e. twice per cylinder. This lack of information can force the ignition module to start the ignition coil charging sufficiently early so that the coil will have sufficient energy stored to provide an adequate spark irrespective of any change in instantaneous engine rotational velocity. The time during which ignition coil current flows is termed dwell. The time period during which the coil current is at the desired current limit (i.e. excess dwell) can be as much as 40% of the time between successive ignition coil discharges, which at 750 RPM on a 4 cylinder engine is about 16 milliseconds. During this time period the ignition module output transistor will be dissipating approximately 70 watts of power.

Referring to prior art FIG. 1, a graphical representation with respect to time includes waveform A indicating engine rotational position with respect to time, waveform B indicating a signal to provide spark timing, waveform C indicating the time when ignition coil charging begins and the time when the ignition coil reaches coil current limit, and waveform D indicating ignition coil current. In waveform D, the flat portion of the waveform after coil current rises to a maximum current limit is excess dwell.

U.S. Pat. No. 4,303,977 issued to Kobashi et al teaches a method for controlling the current through an ignition coil dependent on the engine speed and magnitude of the supply voltage to the ignition coil. This is an open loop control system which adjusts dwell time based on spark advance and the battery voltage. The resulting current flow is not measured and there is no current feedback to adjust the dwell.

U.S. Pat. No. 4,469,081 issued Mate teaches controlling ignition coil current using a particular transfer function in combination with a plurality of counters. Again, there is no current feedback to adjust the dwell.

U.S. Pat. No. 4,649,888 issued Kawai et al teaches computing a desired spark plug ignition time in accordance with engine load and engine rotation speed, and an energization starting time of an ignition coil in accordance with the ignition timing. The energization starting time is retarded in accordance with the primary current through the ignition coil and the energization time of the ignition coil is reduced. A digital integrator is used to establish the on, or conducting time, of the ignition coil. There is no determination of the coil charge requirement.

U.S. Pat. No. 4,347,570 issued to Akiyama et al teaches an open loop dwell calculation which provides a minimum limit for dwell time and allows spark timing error to occur. The coil current is not measured and there is no feedback of the coil current. As a result, the spark timing is controlled by the dwell. Such a variance of spark timing may be unacceptable where a particular spark timing is desired for optimum engine performance.

U.S. Pat. No. 4,538,585 issued Arguello et al teaches a correction of the next spark event based upon the previous spark event. That is, there is no learned system correction which can be applied. In operation, a current limit adjust window is established for each period. The time of the termination of a dwell in the period relative to the current limit adjust window established for the period starts the dwell in the next period relative to the beginning of the next period at a time calculated to optimize engine performance and minimize energy losses.

In, U.S. Pat. No. 4,519,038 issued to Matsui et al, a reference pulse is generated in response to a predetermined engine crankshaft position. The reference pulse has a leading edge advanced with respect to that predetermined position as a function of the rotational speed of the crankshaft. No feedback of ignition coil current is taught.

U.S. Pat. No. 4,665,884 issued to Yoshida et al teaches an ignition control apparatus arranged to control an ignition timing and a current conduction initiating timing on the basis of a time elapsed from a point in time at which a reference position is reached by a crankshaft. An open loop system is used to control dwell. There is no current limit feedback.

It would be desirable to improve the control of dwell so that excess dwell is reduced. Accordingly, there would be a reduction in the temperature build up within the ignition module by supplying current to the coil only for the period when the coil is charging.

SUMMARY OF THE INVENTION

This invention uses a detected primary voltage of the ignition coil to indicate when the ignition coil current reaches a desired current limit and in order to learn the coil charging time. More specifically, the system learns the coil charging time by monitoring the time duration from the initiation of the coil charging to the time when coil current reaches the current limit. The portion of the total dwell time that the ignition coil current is at the desired current limit level is an excess dwell which is reduced in subsequent dwells. This reduction occurs by repositioning the start of ignition coil charging a desired time duration before the occurrence of the spark initiation.

DETAILED DESCRIPTION OF THE INVENTION

Figure 3:
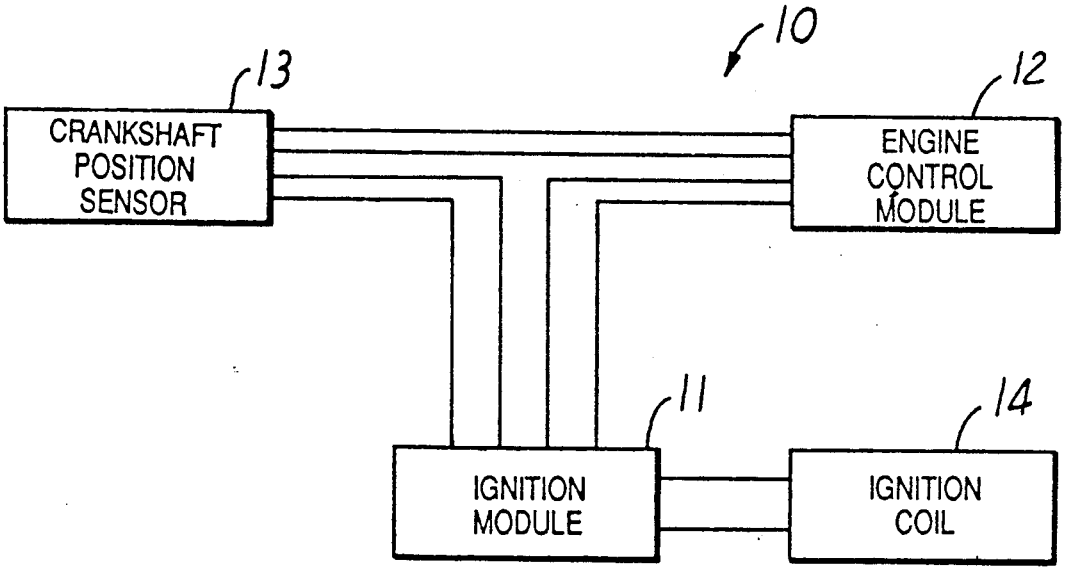
FIG. 3 is a block diagram of an ignition system for an internal combustion engine in accordance with an embodiment of this invention.

Referring to FIG. 3, an ignition control system 10 includes an ignition module 11, an electronic engine control module 12, a crankshaft position sensor 13, and an ignition coil 14. Electronic engine control module 12 includes a microprocessor and memory for executing an electronic engine control strategy which controls ignition timing.

Figures 1A, 1B, 1C, 1D:
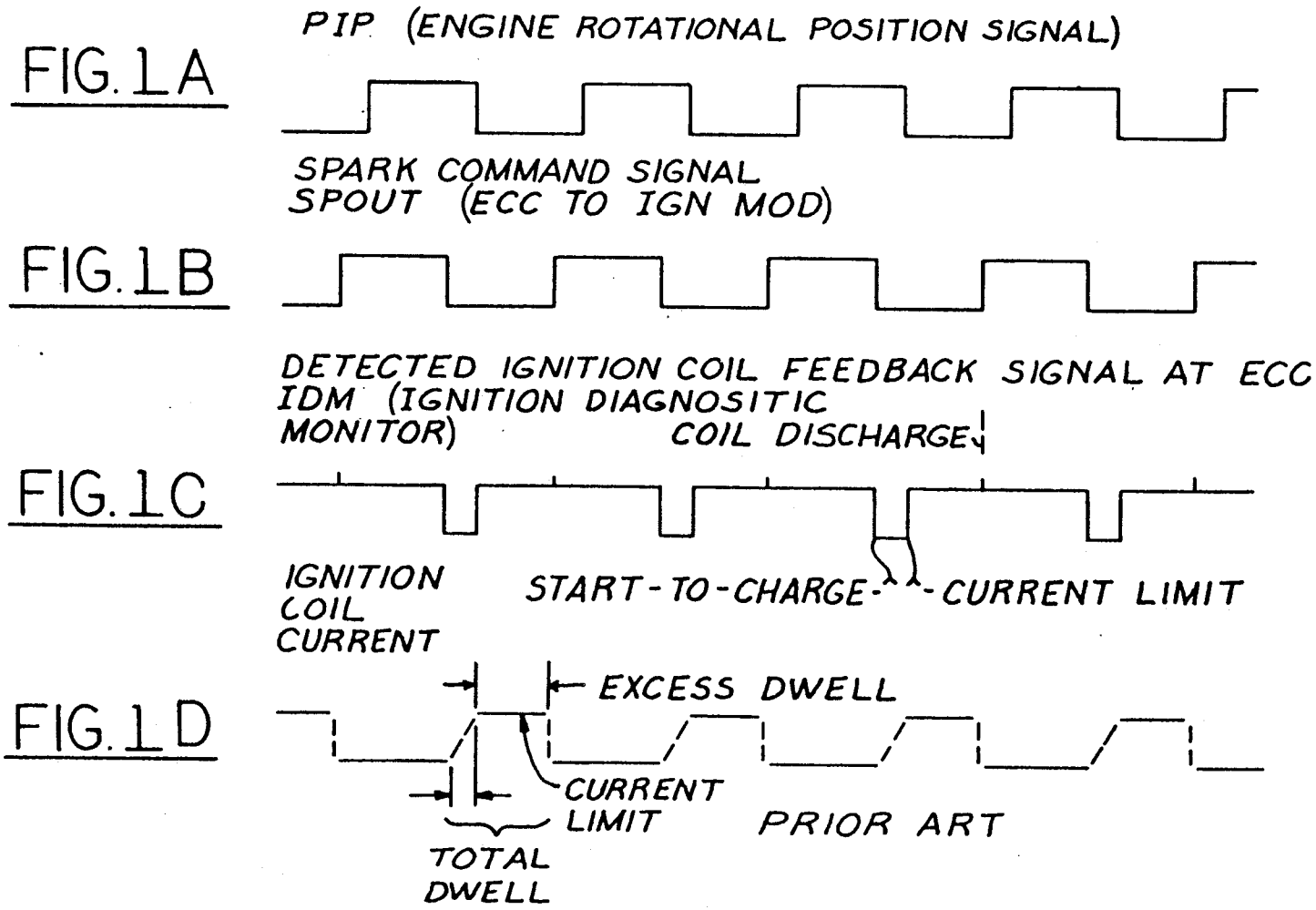
FIG. 1 is a graphical representation versus time of various ignition waveforms in accordance with the prior art.
Figure 2A:
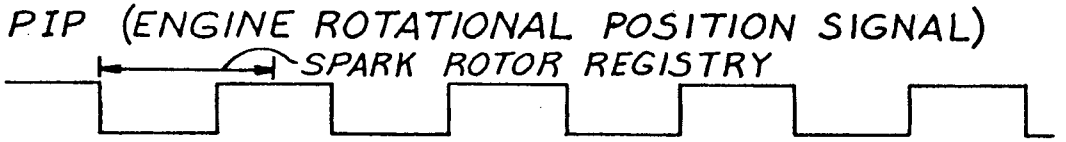
FIG. 2 is a graphical representation versus time of the waveforms of an ignition system in accordance with an embodiment of this invention operating in a closed loop feedback ignition control mode.
Figure 2B:
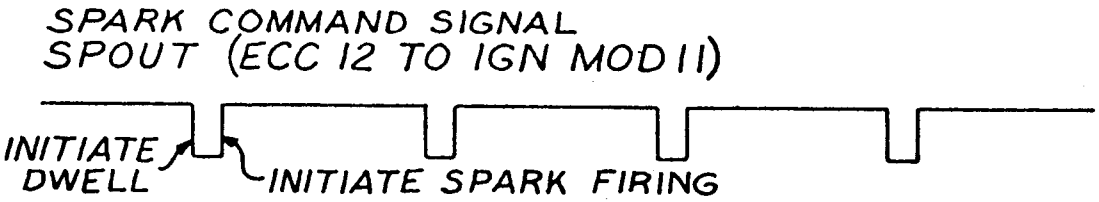
Figure 2C:
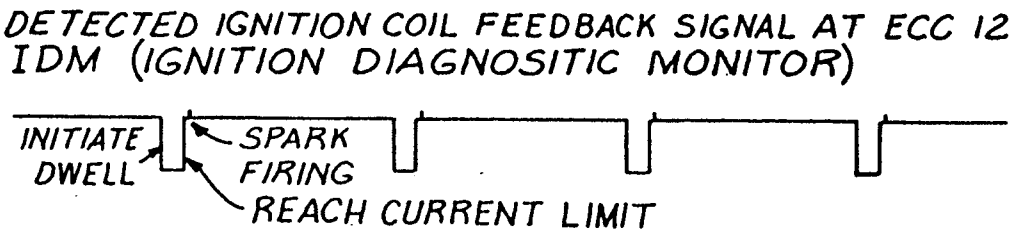
Figure 2D:
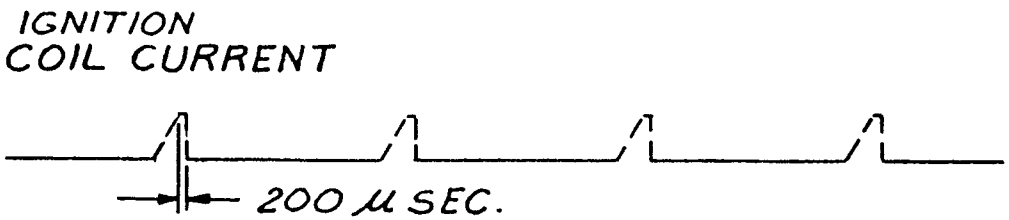

Referring to FIG. 2 a graphical representation of waveforms with respect to time at various points on the circuit of FIG. 3 is analogous to the waveforms of FIG. 1. That is, waveform A indicates engine rotational position, waveform B indicates a spark command signal to provide spark timing, waveform C indicates the time when ignition coil charging begins and the time when the ignition coil current reaches coil current limit, and waveform D indicates ignition coil current magnitude, all with respect to time. The rising and falling edges of waveform A generated by crankshaft position sensor 13 can be used to determine engine speed and position. Waveform B is an output signal (spark command) of engine control module 12 applied to ignition module 11. Waveform C is an output signal (IDM—Ignition Diagnostic Monitor) of ignition module 11 applied to electronic engine control module 12. Contained within these signals is information as to the time ignition module 11 started the charging of ignition coil 14, the time ignition coil 14 reached a preset current limit, the time ignition coil 14 fired a spark plug, and the duration of the discharge across the spark plug.

Ignition control system 10 can provide near zero excess dwell during low engine speed operation. This is accomplished while maintaining spark timing at a desired setting. That is, the rising edge of the spark command signal (waveform B) initiates spark firing, and the position of this rising edge is not changed. The falling edge of the spark command signal initiates dwell as well as the falling edge of the ignition coil feedback signal (waveform C). The engine control strategy is designed to provide a closed loop dwell function at any time that both the falling dwell edge of the spark command signal and the rising spark edge of the spark command signal can be positioned within the time limits after the falling edge of the engine position signal (i.e. PIP down edge) and before the end of spark rotor registry. In a distributor, spark rotor registry occurs as long as the central turning rotor is in electrical contact with one of the spark plug contacts located around the travel path of the rotor tip. A given engine position signal is uniquely associated with one spark plug contact.

An ignition coil feedback signal, i.e. an IDM or ignition diagnostic monitor signal as in waveform C, includes information as to the time the ignition module has started the coil charging (in response to the spark command signal), the time the coil current reached current limit, the time the coil fired, and the duration of the discharge across the spark plug. Because the time duration between the start of coil current flow and reaching current limit for the coil current is the maximum amount of time during which the output transistor should operate, it is possible to adaptively learn this duration of time. Factors which affect the magnitude of this time duration include battery voltage and ignition coil temperature. Other considerations as to when the feedback (IDM signal) information can be used to adaptively lean this duration of time are engine speed and desired spark position.

By gathering this information electronic engine control module 12 can take control of the charging of the coil, and during low engine speeds, provide a near zero, amount of time when the coil current is at current limit. That is, excess dwell is reduced to near zero and is a relatively small portion of an ignition cycle. Advantageously, excess dwell can be reduced to about less than 200 microseconds. In part, this time duration is a function of the recognition of the edges diagnostic monitor signal by engine control module 12. At other engine speeds, this information is used to reduce the amount of time the coil is in current limit with the overall effect of a significant reduction in ignition module and output transistor temperatures. Calculation of base dwell is in accordance with:

$$\text{Base Dwell} = 1/[\text{Multiplier} \times (\text{Battery Voltage} - \text{Adder})]$$

wherein Multiplier and Adder are empirically determined constants and Battery Voltage is the detected vehicle battery voltage. Calculation of excess dwell is in accordance with:

Excess Dwell = (time of scheduled spark firing minus actual time coil reached current limit)

if the coil does not reach current limit then excess dwell is equal to zero.

Advantageously, closed loop feedback adjustment of the beginning of dwell is not done in those instances when the falling dwell edge of the spark command signal cannot be positioned after the down edge of the engine position signal, and before the end of spark rotor registry. In such cases, ignition strategy can use open loop techniques and calculate dwell as a function of engine acceleration and desired spark timing. Under steady-state conditions this may produce some excess dwell but will still permit achieving the preset ignition coil current even in cases of maximum acceleration or spark advance change.

The closed loop function for calculation of the basic dwell requirements uses the up and down edges of the ignition coil feedback signal at engine control module 12 to provide a signal that indicates when ignition coil 14 reaches full charge as well as the time when ignition coil 14 is commanded to begin charging by a spark command signal from electronic engine control module 12 (i.e. a SPOUT or spark out signal). When the engine is being started, electronic engine control module 12 schedules the signal initiating dwell at the down edge of the engine position signal due to the highly variable acceleration rates of the engine and the low data rate of the incoming engine position signal. Before the first engine position signal edge is detected the spark command signal is held at a high level to prevent the ignition coil from charging. This protects ignition module 11 if the engine stalls during power up.

Figure 4A:
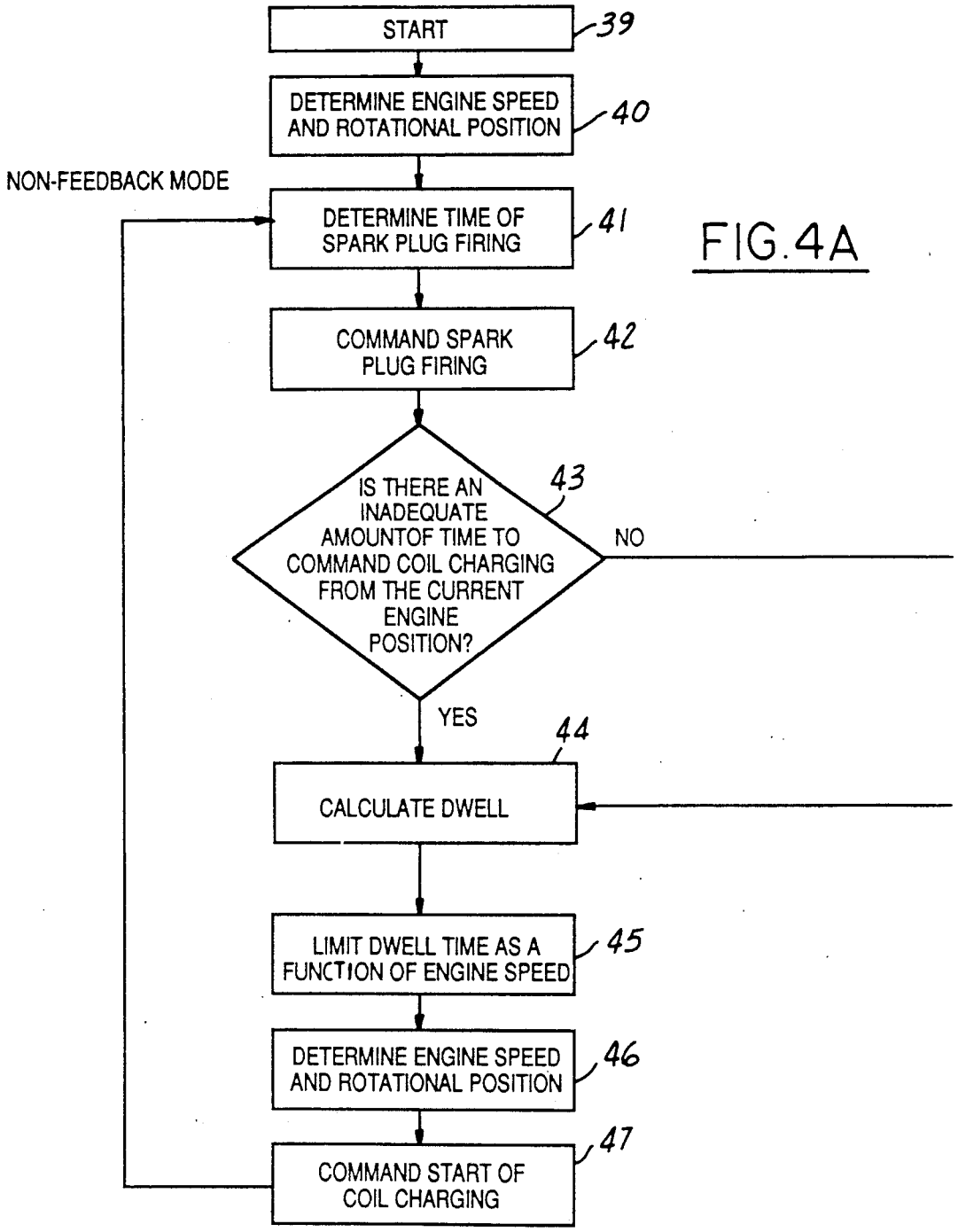
FIGS. 4A and 4B are a logic flow diagram of a method of ignition control including a nonfeedback open loop mode and a feedback closed loop mode, respectively, in accordance with an embodiment of this invention.

Referring to FIG. 4A, logic flow starts at block 39 and then goes to block 40 where engine speed and rotational position are determined. Logic flow from block 40 goes sequentially to blocks 41, 42, and 43. At block 41 the spark plug firing time is determined, at block 42 the spark plug firing is commanded and at block 43 there is an interrogation whether there is an inadequate amount of time to command coil charging from the current engine position. If the answer is YES, and there is inadequate time to command coil charging from the current engine position, logic flow goes to block 44 wherein dwell is calculated. From block 44 logic flow continues sequentially to blocks 45, 46 and 47. At block 45 the dwell time is limited as a function of engine speed. For example, dwell is limited as a function of a percentage of the time needed for one engine revolution, the percentage increasing at higher engine speeds and the percentage decreasing at lower engine speeds. Typically, dwell is limited to 50% at low engine speeds and 80% at high engine speeds. At block 46 engine speed and rotational position are determined. Both the falling and rising edges of the engine rotational position signal are used. At block 47 the start of coil charging is commanded. From block 47 logic flow continues back to block 41.

Figure 4B:
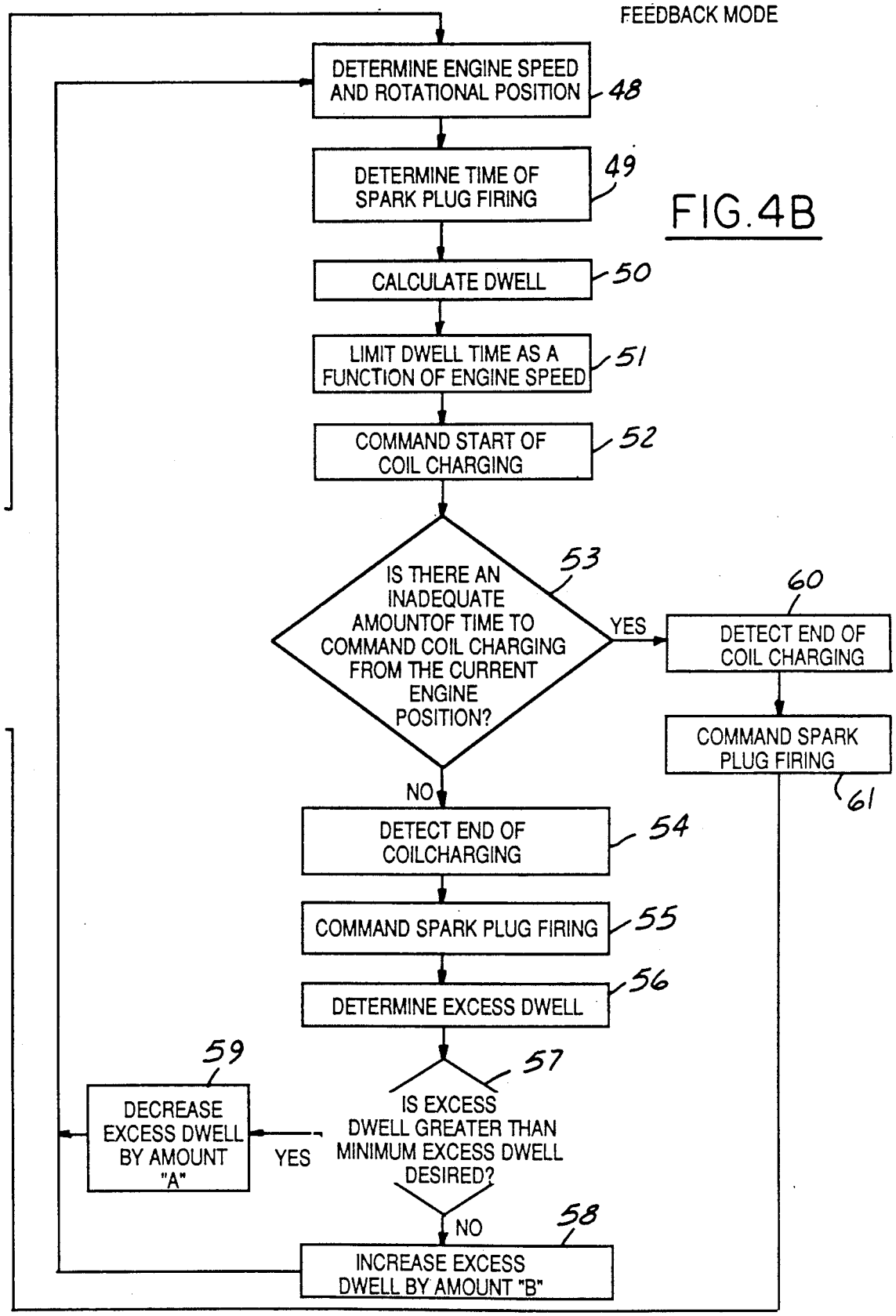

If at block 43 it was determined that the answer is NO, and that there is not an inadequate amount of time to command coil charging from the current engine position, logic flow goes to a block 48 (FIG. 4B) wherein engine speed and rotational position are determined. Continuing to refer to FIG. 4B, from block 48 logic flow goes sequentially to blocks 49, 50, 51, 52 and 53. At block 49 the spark plug firing time is determined. At block 50 dwell is calculated. At block 51 the dwell time is limited as a function of engine speed. At block 52 the coil current charging is commanded to start. At block 53 the same interrogation takes place as at block 43.

If the answer at block 53 is that there is not an inadequate amount of time to command coil charging from the current engine position, logic flow goes to block 54 where the end of coil charging is detected. From block 54 logic flow proceeds to block 55 where spark plug firing is commanded, then to block 56 where excess dwell is determined and to block 57 wherein there is an interrogation whether excess dwell is greater than the minimum excess dwell desired. If there is not excess dwell greater than the minimum excess dwell desired, logic flow goes to block 58 where excess dwell is increased by an amount B. If at block 57 it is determined that the answer is YES and excess dwell is greater than the minimum excess dwell (e.g. 200 microseconds) desired, logic flow goes to a block 59 wherein excess dwell is reduced by an amount A. For example, excess dwell can be reduced by 50%. Logic flow from both blocks 58 and 59 goes back to block 48.

If at block 53 the answer is YES, and there is an inadequate amount of time to command coil charging from the current engine position, logic flow goes to a block 60 where the end of coil charging is detected. From block 60 logic flow proceeds to a block 61 wherein spark plug firing is commanded. Logic flow from block 61 returns to block 44. Generally speaking, the operation of the ignition system from blocks 40 through 47 of FIG. 4A can be characterized as a non-feedback open loop mode of ignition system control. On the other hand, the operation of the ignition system logic flow from block 48 through block 61 of FIG. 4B can be characterized as operation of the ignition system in a feedback closed loop mode.

Figure 5:
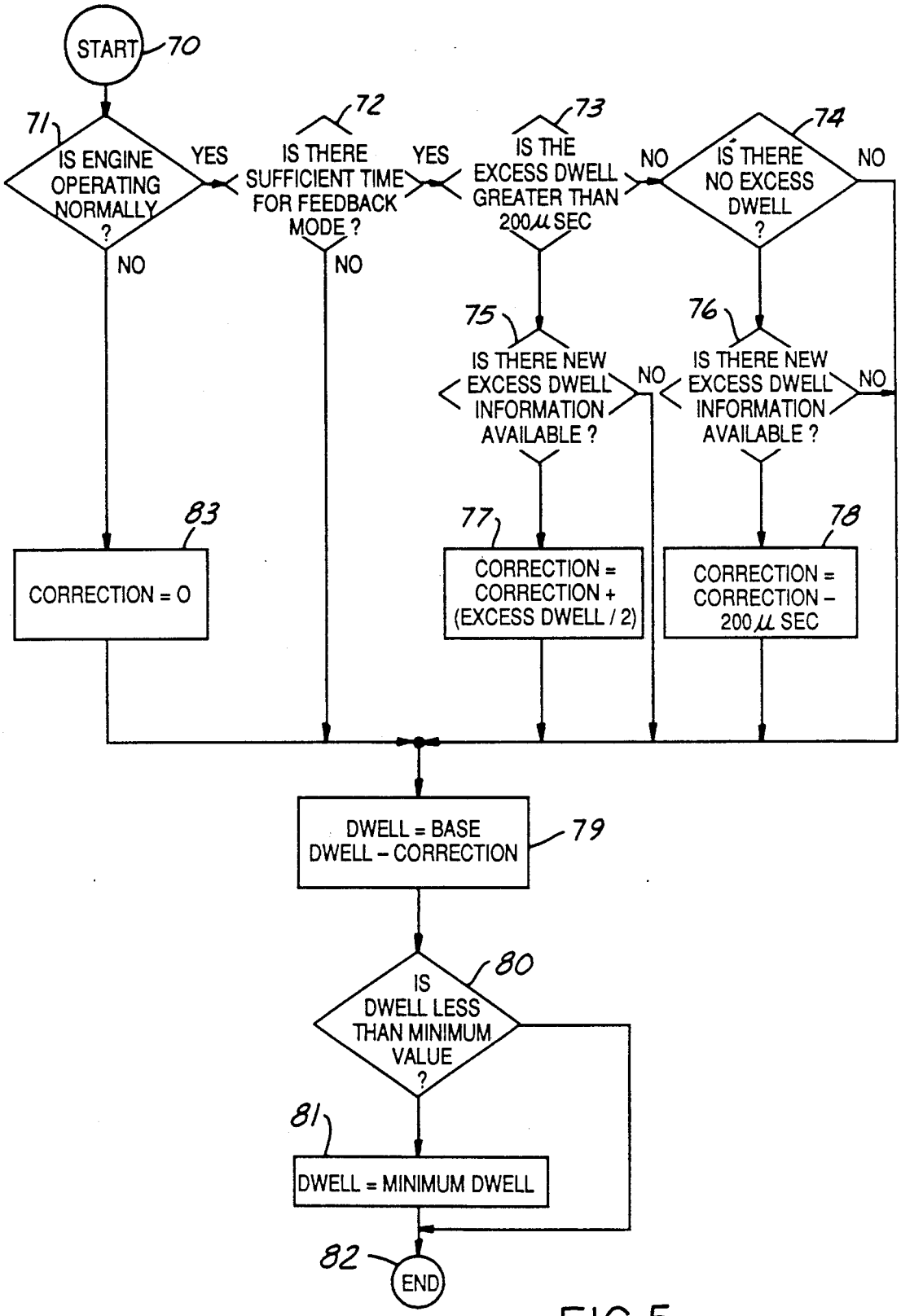
FIG. 5 is a more detailed logic flow diagram of a portion of FIG. 4B including correction of dwell.

Referring to FIG. 5, a more detailed logic flow showing dwell determination begins at a logic block 70. Logic flow then goes to a decision block 71 wherein it is questioned whether the engine is operating normally. If the engine is not operating normally (NO), logic flow goes to block 83. If the engine is operationing normally (YES), logic flow goes to a decision block 72. Block 72 is analogous to block 53 of FIG. 4B and questions if there is sufficient time for feedback mode. If NO, logic flow goes to block 79. If YES, logic flow goes to a decision block 73 wherein it is questioned if the excess dwell is greater than 200 microseconds. If the answer is YES, the logic flow goes to a decision block 75 wherein it is questioned if there is available new excess dwell information. If the answer is YES, logic flow goes to block 77 wherein there is a new value established for a correction which is equal to the previous correction plus one-half of the excess dwell. If answer at block 75 is that there is no new excess dwell information (NO) available then logic flow goes to block 79.

Returning to block 73, if the answer is NO and the excess dwell is not greater than 200 microseconds, logic flow goes to a decision block 74 wherein it is questioned if there is NO excess dwell. If the answer is YES, logic flow goes to a decision block 76 wherein it is questioned if there is new excess dwell information available. If the answer is YES, and there is new excess dwell information available logic flow goes to a block 78 wherein a new value is established for a correction equal to the old correction minus 200 microseconds. Logic flow from block 78 goes to block 79. Returning to block 74, if the answer is that NO to the question (Is there NO excess dwell?), logic flow goes to block 79.

As indicated above, logic flow to block 79 comes from block 83, the NO decision of block 72, from block 77, from the NO decision of block 75, from block 78, from the NO decision of block 74, and from the NO decision of block 76. At block 79 the dwell is set equal to the base dwell minus the correction. Logic flow then goes to a decision block 80 wherein it is asked if dwell is less than the minumum value. If the answer is YES, logic flow goes to a block 81 wherein dwell is set equal to the minumum dwell. If at block 80 the answer is NO, and dwell is not less than the minumum value, logic flow goes to a block 82 where the logic sequence is ended. Logic flow from block 81 also goes to block 82 to end the logic sequence.

Various modifications and variations will no doubt occur to those skilled in the arts to which this invention pertains. For example, the particular parameters of the ignition control strategy may be varied from that disclosed herein. These and all other variations which basically rely on the teachings through which this disclosure has advanced the art are properly considered within the scope of this invention.

We claim:

1. A method of controlling ignition current in an electronic engine control system for an internal combustion engine includes the steps of:

detecting the start of ignition coil charging current in the primary coil of an ignition coil;

detecting the time when the current in the primary ignition coil reaches a desired current limit;

determining the time of spark plug firing;

determining the time between the start of primary coil charging current and the spark plug firing; and adjusting the time of starting primary coil current charging before the spark plug firing as a function of the amount of time of primary ignition coil charging to reach the desired current limit.

2. A method as received in claim 1 further comprising the step of:

decreasing the amount of excess dwell, during which time ignition coil charging current is at the desired current limit, by a predetermined amount.

3. A method as recited in claim 2 wherein the amount of excess dwell is decreased by about one-half.

4. A method as recited in claim 2 wherein decreasing the amount of excess dwell is done repetitively and the resulting excess dwell is a relatively small portion of an ignition cycle.

5. A method as recited in claim 4 wherein the resulting excess dwell is less than about 200 microseconds.

6. A method as recited in claim 5 wherein both the rising and falling edges of an engine rotational position signal are used to control current changes in the primary coil charging current and dwell is limited as function of engine speed.

7. A method of controlling ignition current in an electronic engine control system for an internal combustion engine includes the steps of:

generating an engine rotational position signal;

detecting the start of ignition coil charging current in the primary coil of an ignition coil;

detecting the time when the current in the primary ignition coil reaches a desired current limit;

determining the time of spark plug firing;

determining the time (dwell) between the start of primary coil charging current and the spark plug firing;

determining the amount of time current flows at the desired current limit (excess dwell);

adjusting the time of starting primary coil current charging before the spark plug firing as a function of the amount of time of primary ignition coil charging to reach the desired current limit by using both the rising and the falling edges of the engine rotational position signal; and decreasing the amount of excess dwell in each repetitive step by a predetermined amount until the resulting excess dwell is a relatively small portion of an ignition cycle.

8. A method of controlling ignition current in an electronic engine control as recited in claim 7 wherein the amount of excess dwell is reduced by about one-half in each repetitive step and the resulting excess dwell is less than about 200 microseconds.

* * * * *